United States Patent [19]

Goland et al.

[11] 4,183,735

[45] Jan. 15, 1980

[54] RAPPING SYSTEM FOR ELECTROSTATIC PRECIPITATORS

[75] Inventors: Yaacov Goland, Pacific Palisades, Calif.; Ronald M. Long, Redmond, Wash.

[73] Assignee: Joy Manufacturing Company, Pittsburgh, Pa.

[21] Appl. No.: 954,958

[22] Filed: Oct. 26, 1978

[51] Int. Cl.[2] ..... B03C 3/76

[52] U.S. Cl. ..... 55/112; 55/145; 55/300

[58] Field of Search ..... 55/112, 145, 300

[56] References Cited

U.S. PATENT DOCUMENTS

| | | | |
|---|---|---|---|
| 3,483,669 | 12/1969 | Glaeser et al. | 55/112 |
| 3,920,085 | 11/1975 | Bourke | 55/112 X |
| 3,951,628 | 4/1976 | Eskijian | 55/300 |
| 4,008,057 | 2/1977 | Gelfand et al. | 55/112 X |
| 4,120,672 | 10/1978 | Lanese | 55/112 |

FOREIGN PATENT DOCUMENTS

| | | | |
|---|---|---|---|
| 869377 | 5/1961 | United Kingdom | 55/112 |

*Primary Examiner*—Kathleen J. Prunner
*Attorney, Agent, or Firm*—Thomas H. Murray

[57] ABSTRACT

A rapping system is provided for the collecting electrode plates of an electrostatic precipitator. The rapping mechanism is placed above the plates outside the precipitator casing, and the rapping impacts are transmitted by a transmitting member having rigidly joined vertical and horizontal portions. The transmitting member is hingedly or pivotally mounted on a fixed support at the joint between the vertical and horizontal portions. The horizontal portion is connected to a collector plate or to an impact distributing member which is attached to a plurality of collector plates. The vertical portion extends upward to the rapping mechanism and the impacts are transmitted down to the horizontal portion and through the horizontal portion to one or more plates.

9 Claims, 7 Drawing Figures

RAPPING SYSTEM FOR ELECTROSTATIC PRECIPITATORS

BACKGROUND OF THE DISCLOSURE

The present invention relates to electrostatic precipitators, and more particularly to an improved rapping system for such precipitators.

Electrostatic precipitators consist of a number of collecting electrodes which may be plates, or may be of other suitable configurations, with associated high-voltage or corona discharge electrodes to maintain a strong electric field which charges particles passing through it. The charged particles are attracted to the collecting electrodes which are grounded, or of opposite polarity to the high-voltage electrodes, so that the charged particles deposit on the collecting electrodes and are thus removed from the air or gas stream passing through the precipitator. The particulate matter thus removed accumulates on the collecting electrodes and may be allowed to fall off by gravity. In many cases, however, the deposited material builds up quite rapidly, or does not readily fall off, and must be positively removed by suitable means. This is often done by mechanically rapping or jarring the electrodes at regular intervals to knock off the accumulated deposits of particulate matter. Rotating or swinging hammers have been used for this purpose, as well as reciprocating hammers or other impact devices. The rotating or swinging hammers have usually been placed inside the precipitator casing and positioned to directly impact the collecting plates, preferably with horizontally-directed impacts in the plane of the plates and centrally of the plates or at the edges. This arrangement, however, makes it necessary to increase the size of the casing in order to accommodate the hammers, while the rapping mechanism is inaccessible for maintenance or adjustment during operation of the precipitator. It has also been proposed to place the rapping mechanism above the plates but this involves the problem of avoiding interference with the supports and electrical supply system of the high-voltage electrodes which extend between the collecting electrodes.

SUMMARY OF THE INVENTION

The present invention provides a rapping system for mechanically rapping the collecting plates of an electrostatic precipitator in which the hammer or impact mechanism is outside the precipitator casing above the collecting plates in a position where it is accessible during operation of the precipitator and has no moving parts inside the casing.

In accordance with the invention, an impact device or hammer mechanism is provided above the precipitator casing cover plate, with means for transmitting the impacts to collecting electrode plates. For this purpose, an impact transmitting member is provided which has vertical and horizontal portions rigidly joined together, preferably as an integral shaft, and which is pivotally mounted on a fixed support adjacent the joint between the horizontal and vertical portions. The impact transmitting member is preferably mounted so that the vertical portion is at one side of the assembly of collecting plates and the horizontal portion extends parallel to and above the plates and is rigidly attached to the top of a plate at a point between the leading and trailing edges of the plate. Thus, an impact applied to the upper end of the transmitting member is transmitted through the vertical and horizontal portions and applied horizontally to the electrode plate at a desired point near its center. If desired, the impact may be distributed between several plates by a transverse distributing member to which the horizontal portion of the transmitting member is attached. Similarly, under certain conditions, a transverse distributing member can be connected to the vertical portion of the transmitting member. A rapping system is thus provided in which there are no moving parts within the precipitator casing, and the impact device itself is accessible for maintenance or adjustment during operation of the precipitator.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
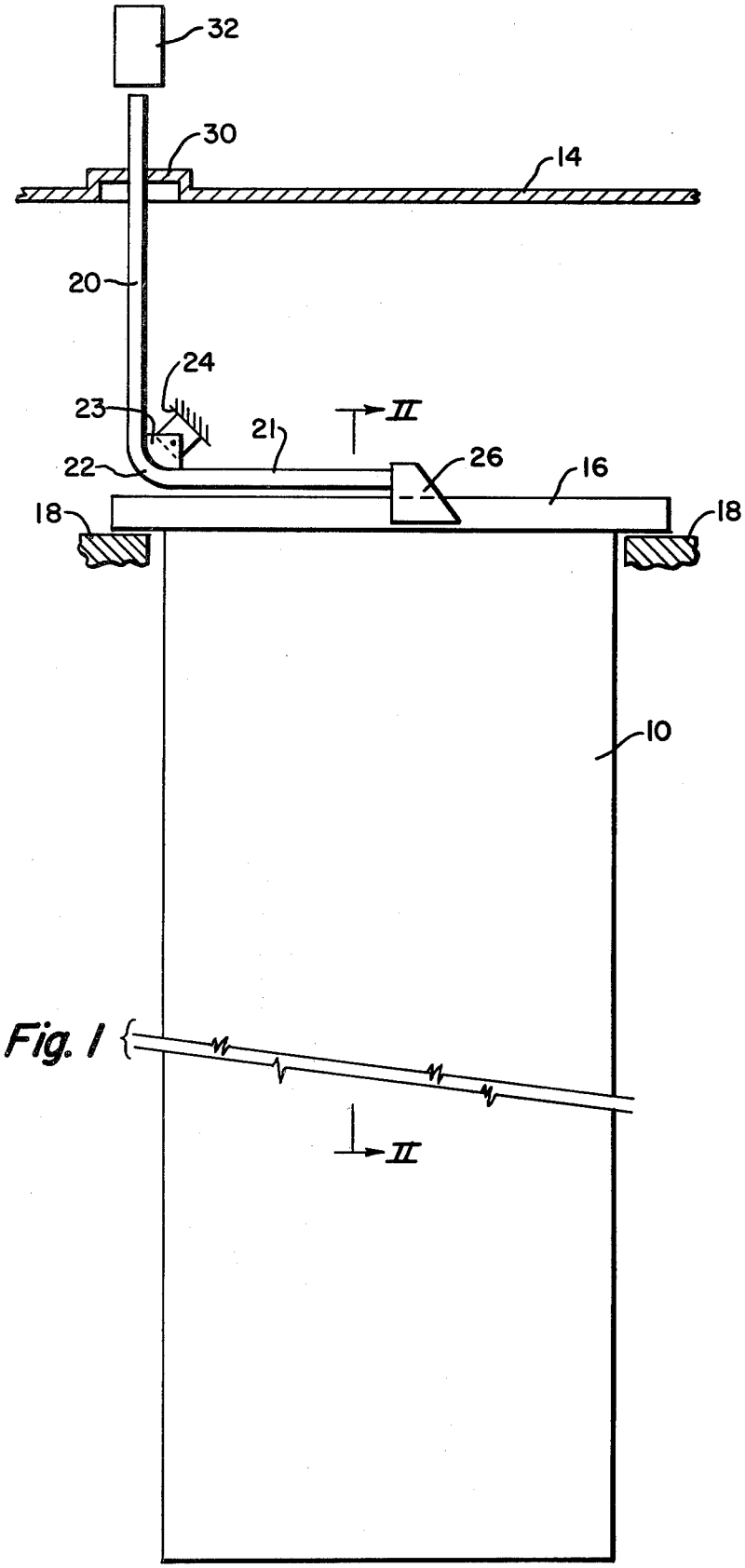
FIG. 1 is a somewhat diagrammatic view, in elevation, of a rapping system for electrostatic precipitators embodying the invention.

The drawing shows somewhat diagrammatically a rapping system in accordance with the invention for transmitting repetitive impacts or blows to the collecting electrodes of a precipitator to knock off accumulated particulate matter.

As shown in FIG. 1, such a precipitator may include a plurality of collecting plates 10 with associated high-voltage discharge electrodes 12. Only one plate is shown in FIG. 1, but it will be understood that a substantial number of spaced, parallel plates 10 would normally be used enclosed in a suitable housing or casing (not shown) with a cover or roof indicated at 14. The high-voltage electrodes 12 may be wires or rods suitably suspended between the parallel plates 10 to maintain a strong electric field between the electrodes 12 and the plates 10 which are preferably grounded. The electrodes 12 may be suspended and electrically energized by any suitable means diagrammatically indicated at 15. Particles carried through the spaces between the plates 10 are thus charged by the electric field and attracted to the grounded collecting plates 10, so that they deposit on the plates and are removed from the stream of air or gas flowing through the precipitator. The plates 10 may be supported in vertical position within the precipitator in any suitable manner. As shown, each plate 10 has a top member 16 extending across its upper edge and resting on fixed supports 18 at each side to support the plate 10.

As previously discussed, charged particles removed from the gas stream deposit on the plates 10 and while some of this material may fall off by gravity, it is usually necessary or desirable to provide means for positively removing it. The present invention provides a rapping system for periodically rapping or jarring the plates to knock the accumulated deposits of particulate matter off them. In accordance with the invention, the impact mechanism for providing the rapping action is located above the roof 14 so that it is outside the precipitator casing. Impacts are transmitted to the plate 10 through a transmitting member consisting of a vertical portion 20 and a horizontal portion 21 rigidly connected together at 22. As shown, the portions 20 and 21 comprise a unitary steel shaft or bar with a right-angle bend at 22. The horizontal and vertical portions 20 and 21, however, could be separate members rigidly connected by plates or otherwise to form a right-angle joint at 22.

Figure 2:
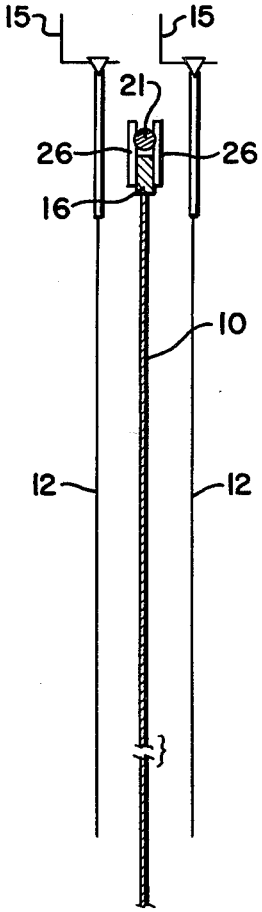
FIG. 2 is a transverse sectional view on the line II—II of FIG. 1.

The impact transmitting member is supported by a hinge or pivotal support shown as comprising a bracket member 23 connected to the joint 22 between the horizontal and vertical portions and pivotally mounted on a fixed support indicated at 24. The support 24 is shown in the given configuration in a schematic manner only. In an actual installation, it will be connected to the portion of the casing which supports the plates 10 such that the support 24 will be away from the high-voltage system. The horizontal portion 21 extends generally parallel to the plate 10 and above it, as shown in FIG. 1. The end of the horizontal portion 21 is attached to the top member 16 at a suitable location intermediate its ends in any suitable manner to effect a rigid connection to the central region of the plate 10. As shown, the horizontal portion 21 is attached by means of plates 26 on each side which may be welded or otherwise joined to the horizontal portion 21 and the top member 16. The horizontal portion 21 is vertically aligned with the top member 16, as can be seen in FIG. 2, and is vertically spaced from it so that it is connected to the electrode plate 10 only at the desired approximately central point. The horizontal portion 21 can thus extend across the top of the plate 10 to the desired location without interfering with the high-voltage electrodes 12 which are mounted between the plates, while the vertical portion 20 is located at one side where it is well removed from the electrodes 12 and their mounting.

The vertical portion 20 of the impact transmitting member extends upward through the roof 14 of the precipitator casing, passing through a guide 30 which preferably also includes suitable sealing means to prevent the entrance of dirt or dust into the precipitator. Repetitive impacts are applied to the upper end of the vertical portion 20 by an impact device indicated at 32 which may be of any suitable or desired type. As illustrated, the impact device 32 may be a reciprocating hammer of the type shown in Archer et al U.S. Pat. No. 3,477,124 in which a magnetic solenoid is used to raise a hammer member and then release it to impact the upper end of the vertical portion 20. If desired, however, any other suitable type of impact device such as a swinging hammer, for example, might be utilized to apply repetitive impacts to the vertical portion 20, or a vibrator of any desired type could be used to vibrate the vertical portion 20 either continuously or intermittently.

In operation, when an impact is applied to the upper end of the vertical portion 20, the impact force is transmitted through the vertical portion 20 to the horizontal portion 21 and applied to the plate 10 through the rigid connection to the top member 16 of the plate, the hinged or pivotal connection 23 permitting the small amount of angular displacement involved. In this way, repeated impacts are applied to the plate 10 from an impact device located outside the precipitator and above the roof 14. The impacts travel vertically downwards through the member 20 and are changed in direction to travel through the member 21 to be applied horizontally to the plate 10 at the desired point intermediate its sides. With this arrangement, no extra space is required inside the precipitator casing for the rapping system, and all moving parts are located above the roof 14 where they are not subject to the dust and dirt inside the precipitator and where they are accessible for maintenance the adjustment, if necessary, during operation of the precipitator. As previously noted, the vertical portion 20 of the impact transmitting member is located at one side of the electrode plate 10 with the horizontal portion vertically aligned with the top 16 of the electrode. All parts of the rapping system, therefore, are well away from the vertical high-voltage electrodes 12 and their mounting or support means 15, so that the rapping mechanism does not interfere in any way with the proper location and support of the high-voltage electrodes.

Figure 3:
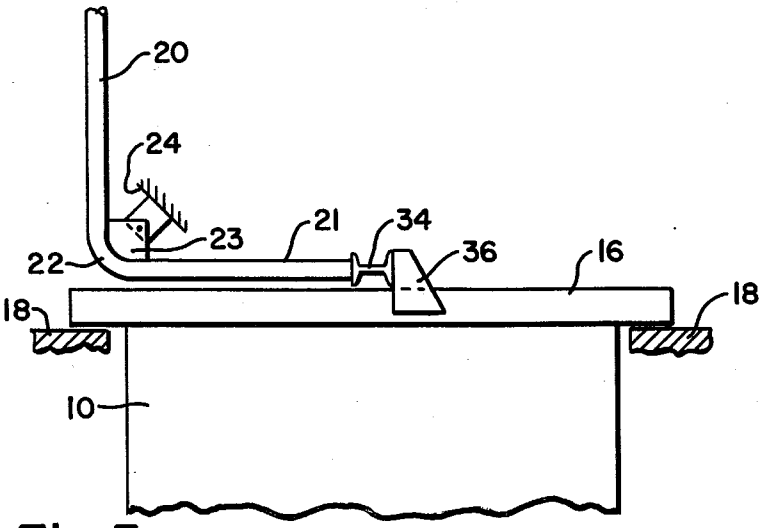
FIG. 3 is a view similar to FIG. 1 showing a modified form of the invention.
Figure 4:
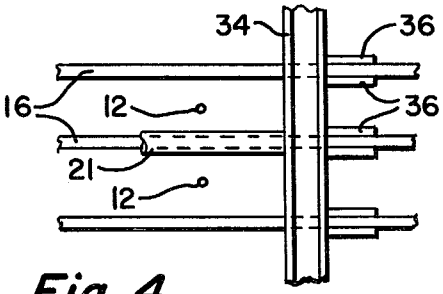
FIG. 4 is a fragmentary plan view of the electrode plate assembly of FIG. 3.

It will be understood that there will normally be a considerable number of parallel collecting plates 10 and an individual rapping system for each plate may be provided as shown in FIG. 1. In order to simplify the installation, however, a common rapping mechanism may be used for a number of plates 10 as shown in FIGS. 3 and 4. The impact transmitting member 20, 21 there shown may be the same as discussed above in connection with FIG. 1 and is mounted in the same manner. An impact distributing member 34 is also provided which may be a structural member, preferably an I-beam as shown, extending transversely across the desired number of electrode plates 10. The horizontal portion 21 of the impact transmitting member is secured to the distributing member 34 substantially at its midpoint, and the distributing member 34 is rigidly attached by plates 36 to the top member 16 of each of the electrode plates. In this way, the impact force transmitted through the horizontal portion 21 is distributed by the member 34 to all of the plates to which it is attached. A single impact device 32 and impact transmitting member can thus be used to rap a substantial number of plates 10. If an odd number of plates 10 is involved, the horizontal portion 21 of the transmitting member is placed in vertical alignment with the center plate of the group, as shown in FIG. 4, so that there is no interference with the high-voltage electrodes 12 between the plates.

Figure 5:
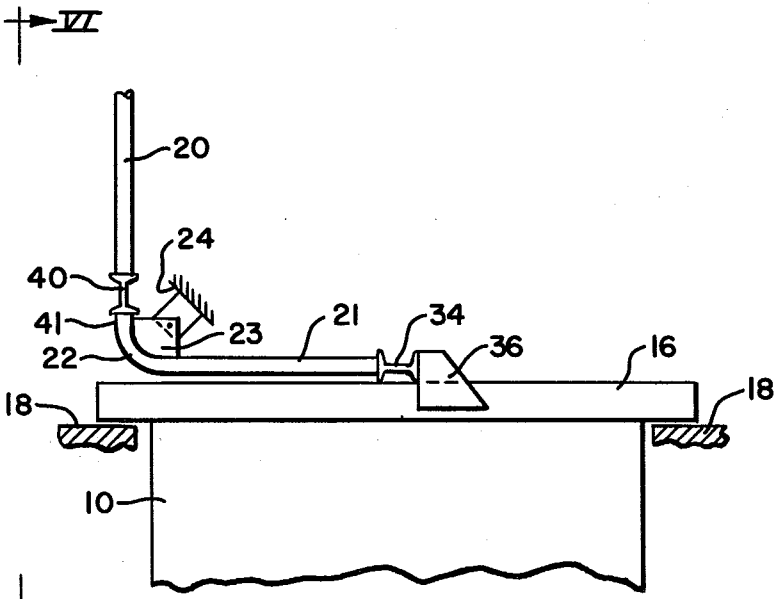
FIG. 5 is a view, in elevation, showing a further modification of the invention.
Figure 7:
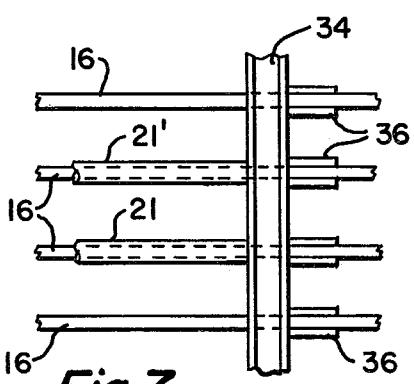
FIG. 7 is a fragmentary plan view of a portion of the assembly of FIG. 5.
Figure 6:
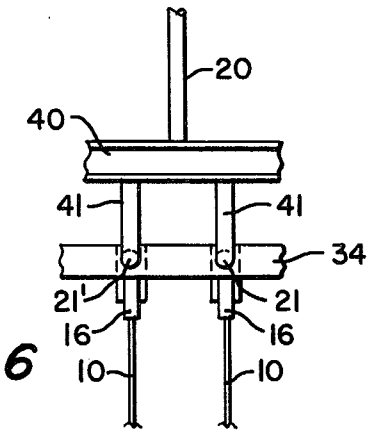
FIG. 6 is a view from the left side of FIG. 5 and taken substantially along line VI—VI of FIG. 5.

FIGS. 5–7 show an alternate arrangement for an even number of plates 10. In this arrangement, a transverse member 40 is provided near the bottom of the vertical portion 20 of the impact transmitting member. The transverse member 40 may be an I-beam, or other suitable structural member, welded or otherwise secured to the lower end of the vertical portion 20. Two horizontal members 21 and 21' are attached to the transverse member 40 by means of short vertical sections 41 which form part of the right-angle joint region 22. The horizontal members 21 and 21' are rigidly attached to the distributing member 34 extending across the plates 10 as described above. Two horizontal members 21 and 21' are shown; but an arrangement with each plate 10 having its own horizontal members could be used. In cases where interference with the high-voltage system will not occur, due to a different high-voltage suspension system, any number of horizontal members could be used, provided that symmetry is retained. In the preferred embodiment, however, two horizontal members 21 and 21' are connected as shown in FIG. 7 to a common distributing member 34. This arrangement is advantageous when the distributing member 34 extends over an even number of electrode plates 10, since the horizontal members 21 and 21' can be arranged in vertical alignment with the two center plates 10 of the group, as shown, and are thus kept away from the high-voltage electrodes between the plates, so that there is no interference with the high-voltage electrodes or their support structure.

It should now be apparent that a rapping system has been provided for electrostatic precipitators in which a series of impacts or rapping blows can be applied at the desired intervals to the collecting electrode plates. The impacts are applied horizontally at the desired point on the plate by means of an impact transmitting member which permits the impacts to be transmitted vertically downward and then horizontally to the desired point of application. In this way, all moving parts can be placed outside of the precipitator casing itself so that no increase in size of the precipitator casing is required. The impact mechanism itself is entirely outside the precipitator casing and is accessible during operation of the precipitator so that it can be adjusted to vary the magnitude or frequency of the impacts to optimize the input rapping energy for any given operating conditions. The impact transmitting member is arranged so that no part of it interferes with the support of the high-voltage electrodes between the collecting plates.

We claim as our invention:

1. In an electrostatic precipitator, a collecting electrode plate on which particulate matter deposits, a top member extending across the top of said electrode plate for supporting the electrode in a vertical position on a fixed support, an impact transmitting member disposed above the electrode and having a horizontal portion and an upwardly-extending vertical portion, said horizontal portion being rigidly joined to the vertical portion and extending generally parallel to said top member, the horizontal portion being rigidly connected to the top member at a point intermediate the ends thereof, means for pivotally mounting the impact transmitting member on a fixed support at the joining between the horizontal and vertical portions, and means for repetitively applying impacts to the upper end of the vertical portion.

2. The combination defined in claim 1 in which said impact transmitting member is a unitary shaft member having a right-angle bend joining the horizontal and vertical portions.

3. The combination defined in claim 1 in which said vertical portion of the impact transmitting member is disposed at one side of the electrode plate.

4. The combination defined in claim 1 in which said horizontal portion is vertically aligned with the electrode plate and spaced from the top member.

5. In an electrostatic precipitator, a plurality of spaced, parallel electrode plates on which particulate matter deposits, a top member extending across the top of each of said electrode plates, said top members supporting the plates in vertical position on a fixed support, an impact transmitting member disposed above the electrode plates and having a horizontal portion and an upwardly-extending vertical portion, said horizontal portion being rigidly joined to the vertical portion and extending generally parallel to said top members, means for pivotally mounting the impact transmitting member on a fixed support at the joining between the horizontal and vertical portions, a distributing member extending transversely across and above said top members intermediate the ends thereof, means for rigidly attaching said distributing member to each of the top members, the horizontal portion of the impact transmitting member being secured to the distributing member, and means for repetitively applying impacts to the upper end of the vertical portion.

6. The combination defined in claim 5 in which the impact transmitting member is a unitary shaft having a right-angle bend joining the horizontal and vertical portions.

7. The combination defined in claim 5 in which the vertical portion of the impact transmitting member is disposed at one side of the electrode plates.

8. The combination defined in claim 5 in which the vertical portion of the impact transmitting member includes a transverse member at its lower end, and in which the horizontal portion includes a plurality of horizontal members extending parallel to said top members and joined to said transverse member, and each horizontal member being secured to said distributing member.

9. The combination defined in claim 8 in which each of said horizontal members is vertically aligned with one of the electrode plates and spaced therefrom.

* * * * *